US005626275A

United States Patent [19]

Chen

[11] Patent Number: 5,626,275

[45] Date of Patent: May 6, 1997

[54] TWIN STAPLER DEVICE

[76] Inventor: Chun-Ku Chen, 58, Ma Yuan West St., Taichung, Taiwan

[21] Appl. No.: 602,032

[22] Filed: Feb. 15, 1996

[51] Int. Cl.[6] ..... B25C 5/11; B25C 7/00

[52] U.S. Cl. ..... 227/110; 227/76; 227/144; 227/154; 227/156

[58] Field of Search ..... 227/27, 64, 76, 227/109, 110, 134, 143, 144, 154, 156

[56] References Cited

U.S. PATENT DOCUMENTS

| | | | |
|---|---|---|---|
| 1,007,258 | 10/1911 | Walker | 227/156 |
| 1,702,095 | 2/1929 | Solheim | 227/76 |
| 2,259,878 | 10/1941 | Clancy | 227/76 |
| 2,679,045 | 5/1954 | Neumann | 227/76 |
| 3,101,478 | 8/1963 | Oussani | 227/76 |
| 3,945,073 | 3/1976 | Adams | 227/76 X |
| 4,288,018 | 9/1981 | Taniguchi | 227/76 |
| 5,178,314 | 1/1993 | Radtke et al. | 227/110 |

*Primary Examiner*—Scott A. Smith
*Assistant Examiner*—Jay A. Stelacone

[57] ABSTRACT

A twin stapler device has a base, a platform on the base, a cover connected to the platform, and at least two staplers disposed between the platform and the cover. The base and the platform are fastened together. A groove is formed on the front periphery of the base to receive a rotor. Two boxes are inserted in the base. The platform has an interior therein, at least two seats formed on the platform to receive staplers. Each seat has two parallel elongated holes. A ridge is disposed between two seats. Two rows of positioning holes are formed on the ridge. A slot is formed between two rows of the positioning holes. A block plate is disposed on the ridge. An adjusting device is disposed in the platform to drive the staplers to move closely or apart.

2 Claims, 3 Drawing Sheets

TWIN STAPLER DEVICE

BACKGROUND OF THE INVENTION

The invention relates to a stapler device. More particularly, the invention relates to a twin stapler device.

The conventional stapler cannot adjust the spacing between two staplers nor fix the positions of two staplers at the same time. Thus the user has to use a single stapler each time.

SUMMARY OF THE INVENTION

An object of the invention is to provide a twin stapler device which have at least two staplers operated at the same time.

Another object of the invention is to provide a twin stapler device which can adjust the spacing between two staplers easily.

Accordingly, a twin stapler device has a base, a platform on the base, a cover connected to the platform, and at least two staplers disposed between the platform and the cover. The base has a plurality of hollow cylinders in the corners of the base. Two block walls are disposed in the base. Two slide passages are disposed in the base. A plurality of supporting plates are disposed in the base. A plurality of props are disposed in the base. A U-groove is formed on a front periphery of the base to receive a rotor. The platform has an interior therein, at least two seats formed on the platform to receive the corresponding staplers. Each of the seats has two parallel elongated holes. A ridge is disposed between two seats. Two rows of a plurality of parallel positioning holes are formed on the ridge. A slot is formed between two rows of the positioning holes. Two lugs are disposed on two rear corners of the platform. A plurality of threaded cylinders are disposed in the corners of the platform. Each of the lugs has a round hole thereon. An L-shaped block plate is disposed on the ridge. The block plate has a front surface, two click hooks under the block plate, two elastic arms, and two protrusions disposed at the ends of the elastic arms. The click hooks are inserted in the slot. The protrusions are clicked in the corresponding positioning holes. A graduated rule is formed on the upper front surface of the platform to adjust the spacing between two staplers. A notch is formed on a front bottom of the platform. The cover has a press portion in the front of the cover, a circular hole and a through hole thereon. The cover and the platform are connected pivotally. A restrained rod passes through the through hole and the upper front portion of the corresponding staplers. An adjusting device has a front and rear screw rods disposed on the corresponding supporting plates. Two ends of each screw rod are inserted in the corresponding recesses of the supporting plates. The left portion of each screw rod has a clockwise external thread. The right portion of each screw rod has a counterclockwise external thread. A gear ratchet is disposed at the middle portion of each screw rod. Each screw rod has two rotatable blocks screwed thereon. Each rotatable block has an inner threaded hole and two upper inserting arms. The inner threaded hole receives the corresponding screw rod. The upper inserting arm are inserted in the corresponding elongated holes. A guide rod is disposed on the props. The guide rod has a front and rear outer threads thereon engaged with the corresponding screw rods. The rotor connects to the front end of the guide rod. An inserted recess which is formed at the bottom of the stapler receives the upper inserting arm. A plurality of threaded fasteners are inserted in the corresponding hollow cylinders and threaded cylinders to fasten the base and the platform together.

DETAILED DESCRIPTION OF THE INVENTION

Figure 1:
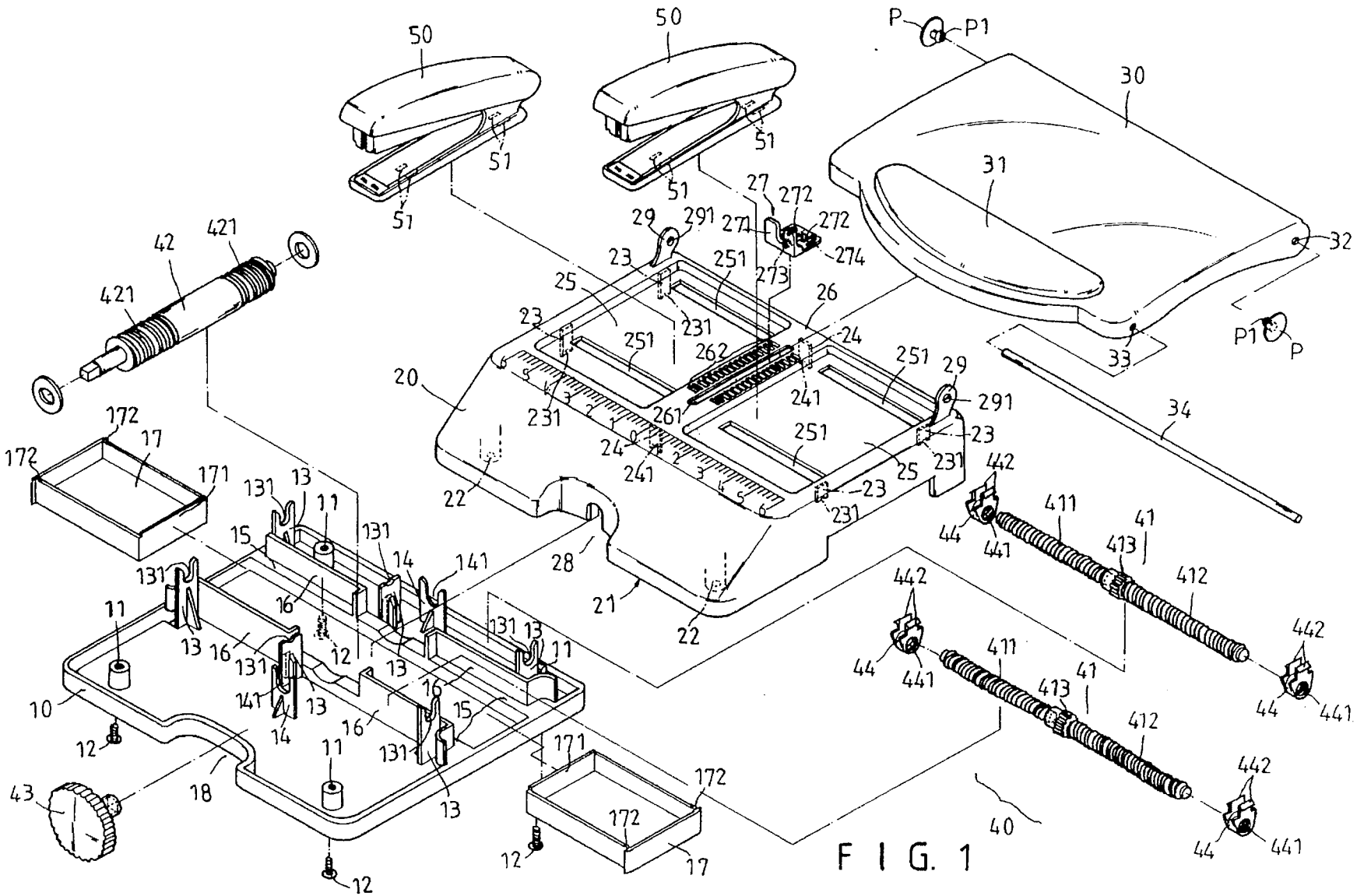
FIG. 1 is a perspective exploded view of a twin stapler device of a preferred embodiment in accordance with the invention.
Figure 2A:
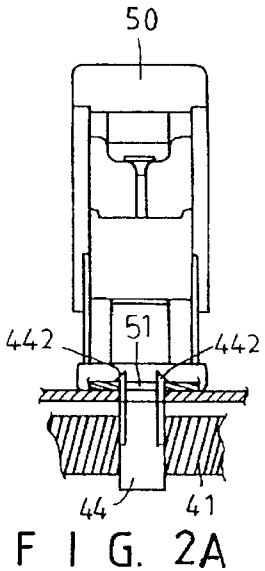
FIGS. 2 and 2A are partially cross-sectional views of a twin stapler device.
Figure 2:
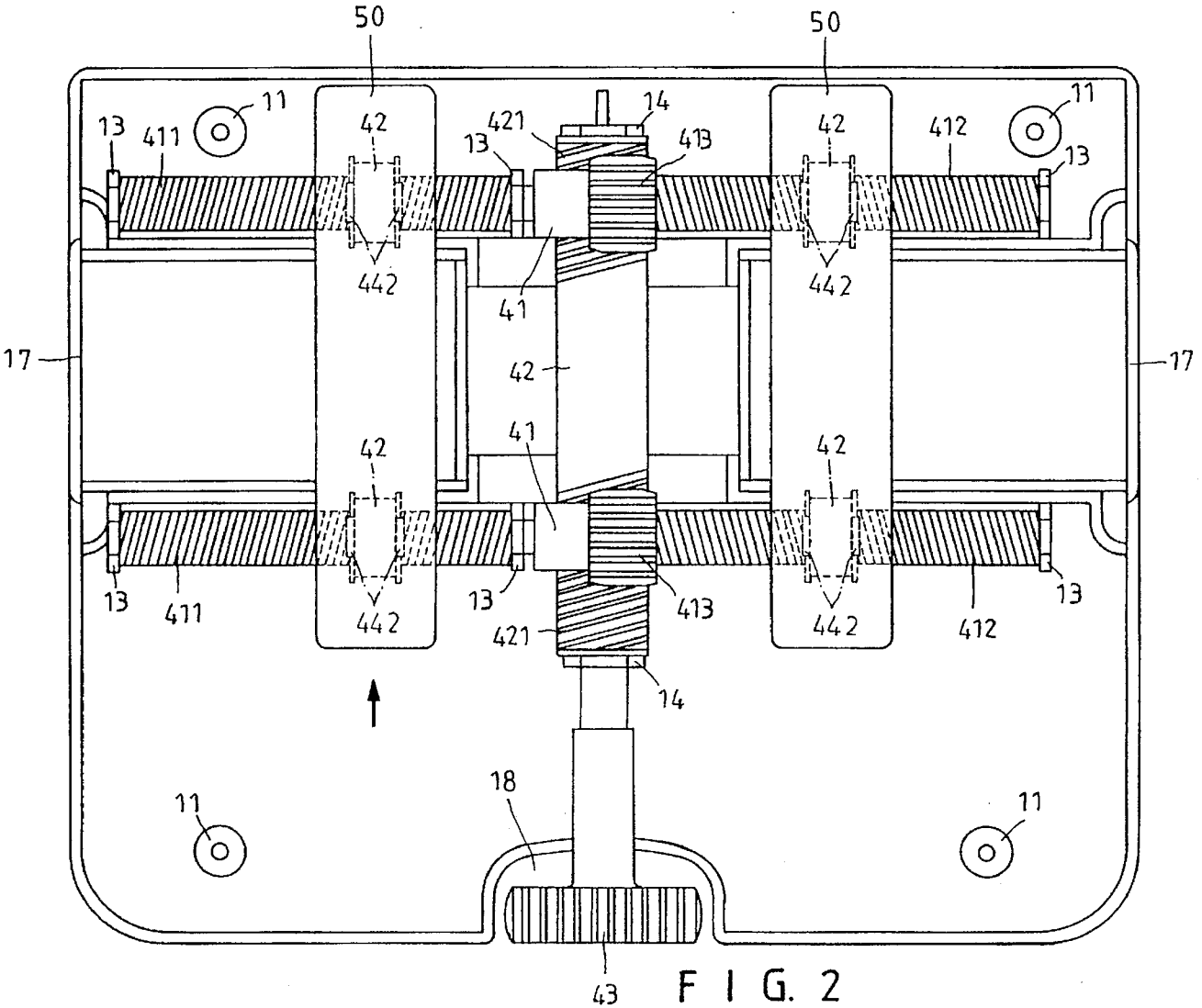
Figure 3:
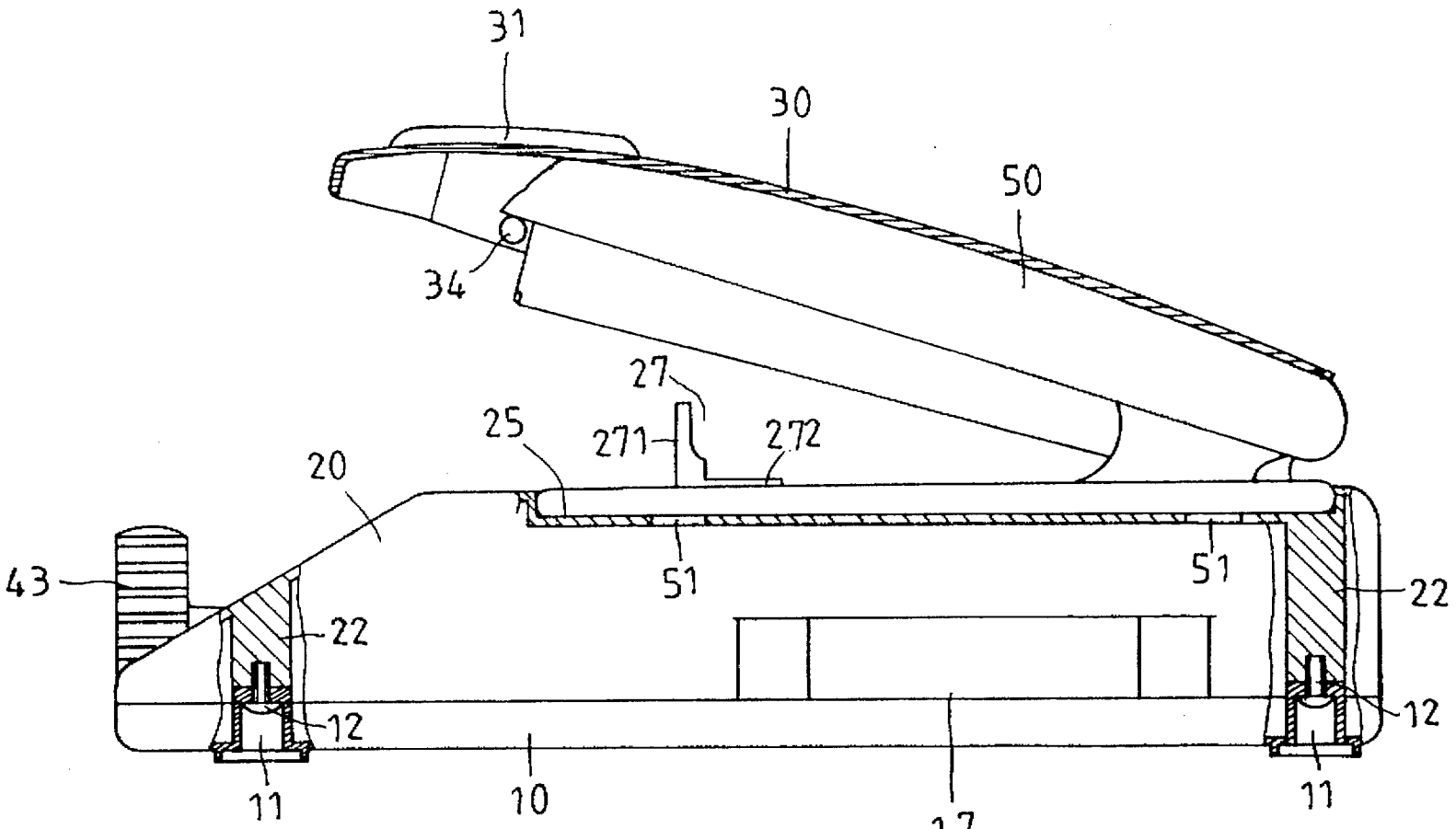
FIG. 3 is another cross-sectional view of a twin stapler device.

Referring to FIGS. 1 to 3, a twin stapler device has a base 10, a platform 20 on the base 10, a cover 30 connected to the platform 20, and at least two staplers 50 disposed between the platform 20 and the cover 30. The base 10 has a plurality of hollow cylinders 11 in the corners of the base 10. Two block walls 16 are disposed in the base 10. Two slide passages 15 are disposed in the base 10. A plurality of supporting plates 13 with recesses 131 thereon are disposed in the base 10. A plurality of props 14 with recesses 141 thereon are disposed in the base 10 also. A U-groove 18 is formed on a front periphery of the base 10 to receive a rotor 43. Two boxes 17 which are inserted in the base 10 via the slide passages 15 are confined by the block walls 16. Each of the boxes 17 has a block strip 171 and two click fasteners 172 thereon. The platform 20 has an interior 21 therein, at least two seats 25 formed on the platform 20 to receive the corresponding staplers 50. Each of the seats 25 has two parallel elongated holes 251. A ridge 26 is disposed between two seats 25. Two rows of a plurality of parallel positioning holes 262 are formed on the ridge 26 A slot 261 is formed between two rows of the positioning holes 262. Two lugs 29 are disposed on two rear corners of the platform 20. A plurality of threaded cylinders 22 are disposed in the corners of the platform 20. Each of the lugs 29 has a round hole 291 thereon. A plurality of plates 23 with recesses 231 thereon are disposed in the platform 20. A plurality of plates 24 with recesses 241 thereon are disposed in the platform 20 also. An L-shaped block plate 27 is disposed on the ridge 26. The block plate 27 has a front surface 271, two click hooks 273 under the block plate 27, two elastic arms 272, and two protrusions 274 disposed at the ends of the elastic arms 272. The click hooks 273 are inserted in the slot 261. The protrusions 274 are clicked in the corresponding positioning holes 262. A graduated rule is formed on the upper front surface of the platform 20 to adjust the spacing between two staplers 50. A notch 28 is formed on a front bottom of the platform 20. The cover 30 has a press portion 31 in the front of the cover 30, a circular hole 32 and a through hole 33 thereon. Two rivets P which have clip rods P1 pass through the circular hole 32 and the corresponding round hole 291 to position the cover 30 on the platform 20 pivotally. A restrained rod 34 passes through the through hole 33 and the upper front portion of the corresponding staplers 50. An adjusting device 40 has a front and rear screw rods 41 disposed on the corresponding supporting plates 13. Two ends of each screw rod 41 are inserted in the corresponding recesses 131 of the supporting plates 13. The left portion of each screw rod 41 has a clockwise external thread 411. The right portion of each screw rod 41 has a counterclockwise external thread 412. A gear ratchet 413 is disposed at the middle portion of each screw rod 41. Each screw rod 41 has two rotatable blocks 44 screwed thereon. Each rotatable block 44 has an inner threaded hole 441 and two upper inserting arms 442. The inner threaded hole 441 receives the corresponding screw rod 41. The upper inserting arm 442 are inserted in the corresponding elongated holes 251. A guide rod 42 is disposed on the corresponding props 14. The guide rod 42 has a front and rear outer threads 421 thereon engaged with the corresponding screw rods 41. The rotor 43 connects to the front end of the guide rod 42. An inserted recess 51 which is formed at the bottom of the stapler 50 receives the upper inserting arm 442. The bolts 12 are inserted in the corresponding hollow cylinders 11 and threaded cylinders 22 to fasten the base 10 and the platform 20 together.

Referring to FIGS. 2, 2A and 3, the rotor 43 can drive the guide rod 42 to drive the rotatable blocks 44. The block plate 27 can be moved forward or rearward so that the front surface 271 can block the stapled article. Then the press portion 31 of the cover 30 is pressed to staple the article.

The invention is not limited to the above embodiment but various modification thereof may be made. Further, various changes in form and detail may be made without departing from the scope of the invention.

I claim:

1. A twin stapler device comprising:

a base having a plurality of hollow cylinders in four corners of said base;

two parallel block walls disposed in said base;

two slide passages disposed in said base;

a plurality of supporting plates disposed in said base;

a plurality of props disposed in said base;

a U-groove formed on a front periphery of said base to receive a rotor;

a platform disposed on said base;

said platform having an interior therein, at least two seats formed on said platform;

a corresponding plurality of staplers received in said at least two seats;

each said seat having two parallel elongated holes;

a ridge disposed between two of said seats;

two rows of a plurality of parallel positioning holes formed on said ridge;

a slot formed between two rows of said positioning holes;

two lugs disposed on two rear corners of said platform;

a plurality of threaded cylinders disposed in said corners of said platform;

each said lug having a round hole thereon;

an L-shaped block plate disposed on said ridge;

a block plate having a front surface, two click hooks under said block plate, two elastic arms, and two protrusions disposed at an end of each said elastic arms;

said click hooks inserted in said slot;

said protrusions clicked in said corresponding positioning holes;

a notch formed on a front bottom of said platform;

a cover having a press portion in a front of said cover, a circular hole and a through hole thereon;

said cover and said platform connected pivotally;

a restrained rod passing through said through hole and an upper front portion of said corresponding staplers;

an adjusting device having a front and rear screw rods disposed on said corresponding supporting plates;

two ends of each said screw rod inserted in corresponding recesses of said supporting plates;

a left portion of each said screw rod having a clockwise external thread, and a right portion of each said screw rod having a counterclockwise external thread;

a gear ratchet disposed at a middle portion of each said screw rod;

each said screw rod having two rotatable blocks screwed thereon;

each said rotatable block having an inner threaded hole and two upper inserting arms;

said inner threaded hole receiving said corresponding screw rod;

said inserting arm inserted in said corresponding elongated hole;

a guide rod disposed on said props;

said guide rod having front and rear outer threads thereon engaged with said corresponding screw rods;

a rotor connecting to a front end of said guide rod;

an inserted recess which is formed at a bottom of each said stapler receiving said inserting arm;

a plurality of threaded fasteners inserted in said corresponding hollow cylinders and said corresponding threaded cylinders to fasten said base and said platform together.

2. A twin stapler device as claimed in claim 1, wherein said platform further comprises a graduated rule on an upper front surface of said platform.

* * * * *